US010566688B2

(12) United States Patent
Chen et al.

(10) Patent No.: US 10,566,688 B2
(45) Date of Patent: Feb. 18, 2020

(54) HORN ANTENNA MODULE AND ANTENNA COVER THEREOF

(71) Applicant: Wistron NeWeb Corp., Hsinchu (TW)

(72) Inventors: Tzong-Jyh Chen, Hsinchu (TW); I-Ching Lan, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 38 days.

(21) Appl. No.: 15/926,967

(22) Filed: Mar. 20, 2018

(65) Prior Publication Data

US 2019/0157750 A1 May 23, 2019

(30) Foreign Application Priority Data

Nov. 20, 2017 (TW) ..... 106140100 A

(51) Int. Cl.
*H01Q 1/42* (2006.01)
*H01Q 13/02* (2006.01)
*H01Q 1/02* (2006.01)

(52) U.S. Cl.
CPC ..... *H01Q 1/42* (2013.01); *H01Q 1/02* (2013.01); *H01Q 13/02* (2013.01); *H01Q 13/025* (2013.01); *H01Q 13/0241* (2013.01)

(58) Field of Classification Search
CPC .... H01Q 1/42; H01Q 13/0241; H01Q 13/025; H01Q 13/02; H01Q 1/02
See application file for complete search history.

(56) References Cited

U.S. PATENT DOCUMENTS 6,501,432 B2 12/2002 Yuanzhu
9,379,457 B2 6/2016 Shiue
2013/0099989 A1* 4/2013 Pantea ..... H01Q 13/0208 343/783
2015/0009083 A1* 1/2015 Shiue ..... H01Q 13/02 343/776

FOREIGN PATENT DOCUMENTS

CN 1047170 A 11/1990
CN 203434286 U 2/2014
EP 2 584 652 A1 4/2013

* cited by examiner

*Primary Examiner* — Hai V Tran
*Assistant Examiner* — Michael M Bouizza

(57) ABSTRACT

A horn antenna module is provided. The horn antenna module includes a waveguide and an antenna cover. The waveguide includes a plurality of waveguide paths. The antenna cover covers one end of the waveguide. The antenna cover includes a plurality of protrusions and a bottom surface. The protrusions are formed on the bottom surface. The protrusions correspond one-to-one with the waveguide paths. Each protrusion has a top surface and a lateral surface. The lateral surface is located between the top surface and the bottom surface. The top surface is planar.

14 Claims, 9 Drawing Sheets

2B-2B 4B-4B

HORN ANTENNA MODULE AND ANTENNA COVER THEREOF

CROSS REFERENCE TO RELATED APPLICATIONS

This Application claims priority of Taiwan Patent Application No. 106140100, filed on Nov. 20, 2017, the entirety of which is incorporated by reference herein.

BACKGROUND OF THE INVENTION

Field of the Invention

The present invention relates to an antenna cover, and in particular to an antenna cover of a horn antenna module.

Description of the Related Art

Conventionally, the free end of a waveguide of a horn antenna is covered by an antenna cover. The antenna cover prevents water from entering the wave guide, and prevents the convertor of the horn antenna from being damaged by water.

Conventional antenna covers are planar, and are made of materials that have a low dielectric coefficient (for example, polypropylene). However, when the environmental temperature changes, the difference between environmental pressure and the inner pressure of the horn antenna deforms the planar antenna cover. The performance (such as cross polarization) of the horn antenna is affected, and the signal transmission of the horn antenna deteriorates.

Conventionally, an antenna cover with one single protrusion is provided to increase the strength of the antenna cover, and to prevent deformation. However, the antenna cover with a single protrusion cannot optimize the signal transmission of each horn antenna on the horn antenna module (for example, one horn antenna module may have one low-band horn antenna and two high-band horn antennae). In particular, the performance of the horn antennas located on lateral sides of the horn antenna module may become deteriorated.

BRIEF SUMMARY OF THE INVENTION

In one embodiment, a horn antenna module is provided. The horn antenna module includes a waveguide and an antenna cover. The waveguide includes a plurality of waveguide paths. The antenna cover covers one end of the waveguide. The antenna cover includes a plurality of protrusions and a bottom surface. The protrusions are formed on the bottom surface. The protrusions correspond one-to-one with the waveguide paths. Each protrusion has a top surface and a lateral surface. The lateral surface is located between the top surface and the bottom surface. The top surface is planar.

In one embodiment, the lateral surface forms a first side and a second side on a cross section, the cross section is perpendicular to the bottom surface, and the first side and the second side are straight lines.

In one embodiment, the lateral surface forms a first side and a second side on a cross section, the cross section is perpendicular to the bottom surface, and the first side and the second side are curves with the same radius.

In one embodiment, the protrusions comprise a first protrusion, a second protrusion and a third protrusion, the waveguide paths comprise a first waveguide path, a second waveguide path and a third waveguide path, the first protrusion corresponds to the first waveguide path, the second protrusion corresponds to the second waveguide path, the third protrusion corresponds to the third waveguide path, the first protrusion is located between the second protrusion and the third protrusion, the first waveguide path transmits a low-band signal, and the second waveguide path and the third waveguide path transmit a high-band signal.

In one embodiment, the top surface of the first protrusion projects a first circular area on a projection plane, the projection plane is parallel to the bottom surface, the first protrusion projects an elliptical area on the projection plane, the ratio of the diameter of the first circular area to the major axis of the elliptical area is between 0.05:1 and 0.4:1.

In one embodiment, the top surface of the second protrusion projects a second circular area on the projection plane, the second protrusion projects a third circular area on the projection plane, and the ratio of the diameter of the second circular area to the diameter of the third circular area is between 0.1:1 and 0.6:1.

In one embodiment, the height of the first protrusion differs from that of the second protrusion and of the third protrusion.

In one embodiment, the first waveguide path comprises a tube-shaped section and a cone-shaped section, one end of the tube-shaped section is connected to a narrow end of the cone-shaped section, a distance is formed between the narrow end and the top surface of the first protrusion, and the distance is equal to a quarter of the wavelength of the low-band signal.

In one embodiment, each protrusion comprises a material feed feature, and the material feed feature is formed on the lateral surface.

In one embodiment, the waveguide path projects a path area on a projection plane, the projection plane is parallel to the bottom surface, and a projection of the material feed feature on the projection plane is out of the path area.

In one embodiment, the material feed feature is a recess.

In one embodiment, an antenna cover is provided. The antenna cover covers an end of a waveguide. The antenna cover includes a plurality of protrusions and a bottom surface. The protrusions are formed on the bottom surface, each protrusion has a top surface and a lateral surface. The lateral surface is located between the top surface and the bottom surface. The top surface is planar.

Utilizing the horn antenna module and the antenna cover of the embodiment of the invention. The protrusions increase the strength of the antenna cover. The antenna cover therefore can resist the difference between the environmental pressure and the inner pressure of the horn antennas due to temperature change. The antenna cover is prevented from deforming, and the thickness of the antenna cover is reduced. The radio frequency (RF) performance of the horn antenna module is therefore improved. The shape of each protrusion can be optimized according to the corresponding waveguide to improve the performance of the horn antenna module. In one embodiment, the cross polarization of the converter utilizing the antenna cover of the embodiment of the invention can be more than 23 dB (full band).

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
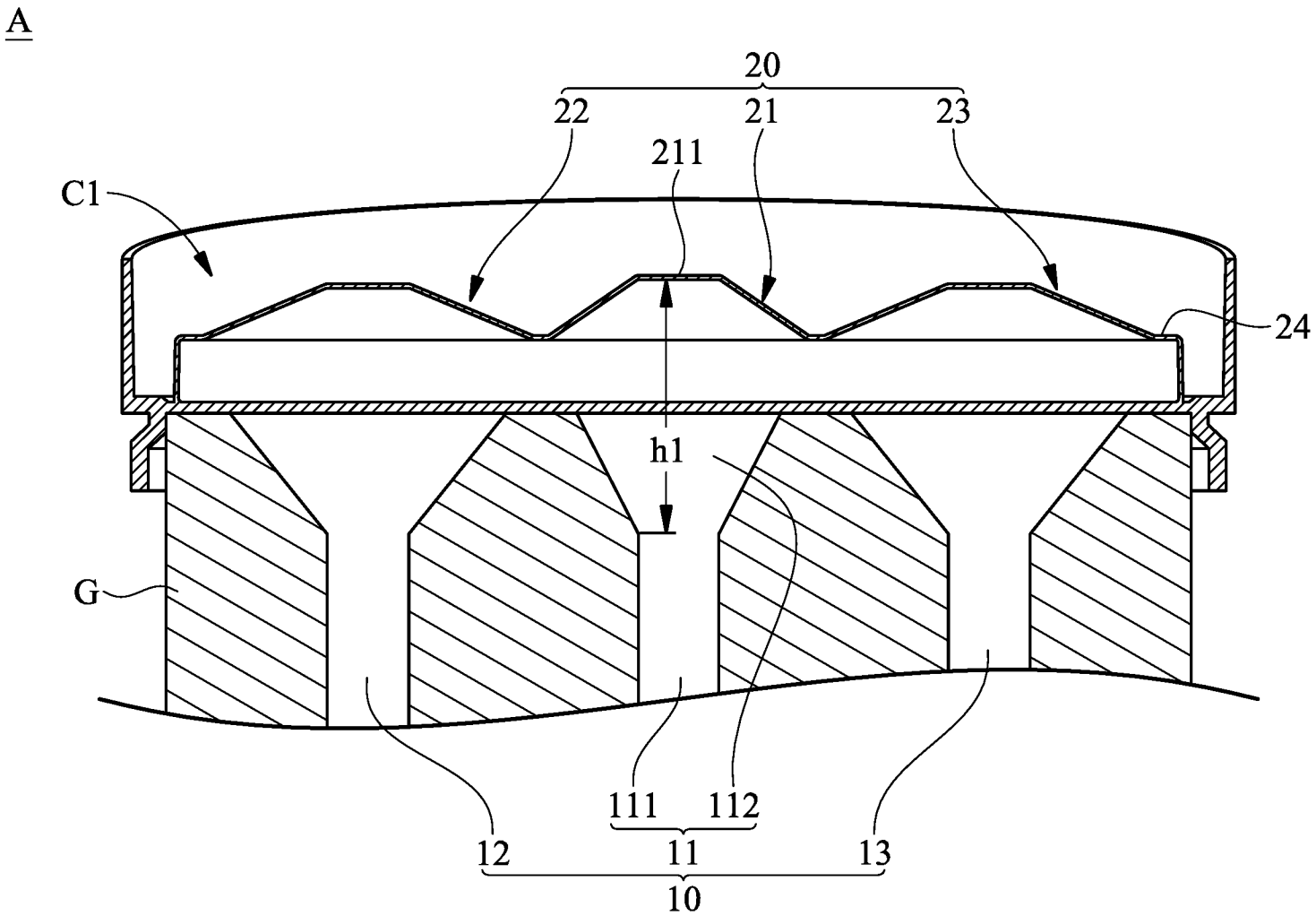
FIG. 1 is a sectional view of a horn antenna module of a first embodiment of the invention.

FIG. 1 is a sectional view of a horn antenna module A of a first embodiment of the invention. With reference to FIG. 1, the horn antenna module A of the first embodiment of the invention includes a waveguide G and an antenna cover C1. The waveguide G includes a plurality of waveguide paths 10. The antenna cover C1 covers one end of the waveguide G. The antenna cover C1 includes a plurality of protrusions 20 and a bottom surface 24. The protrusions 20 are formed on the bottom surface 24. The protrusions 20 correspond one-to-one with the waveguide paths 10.

Figure 2A:
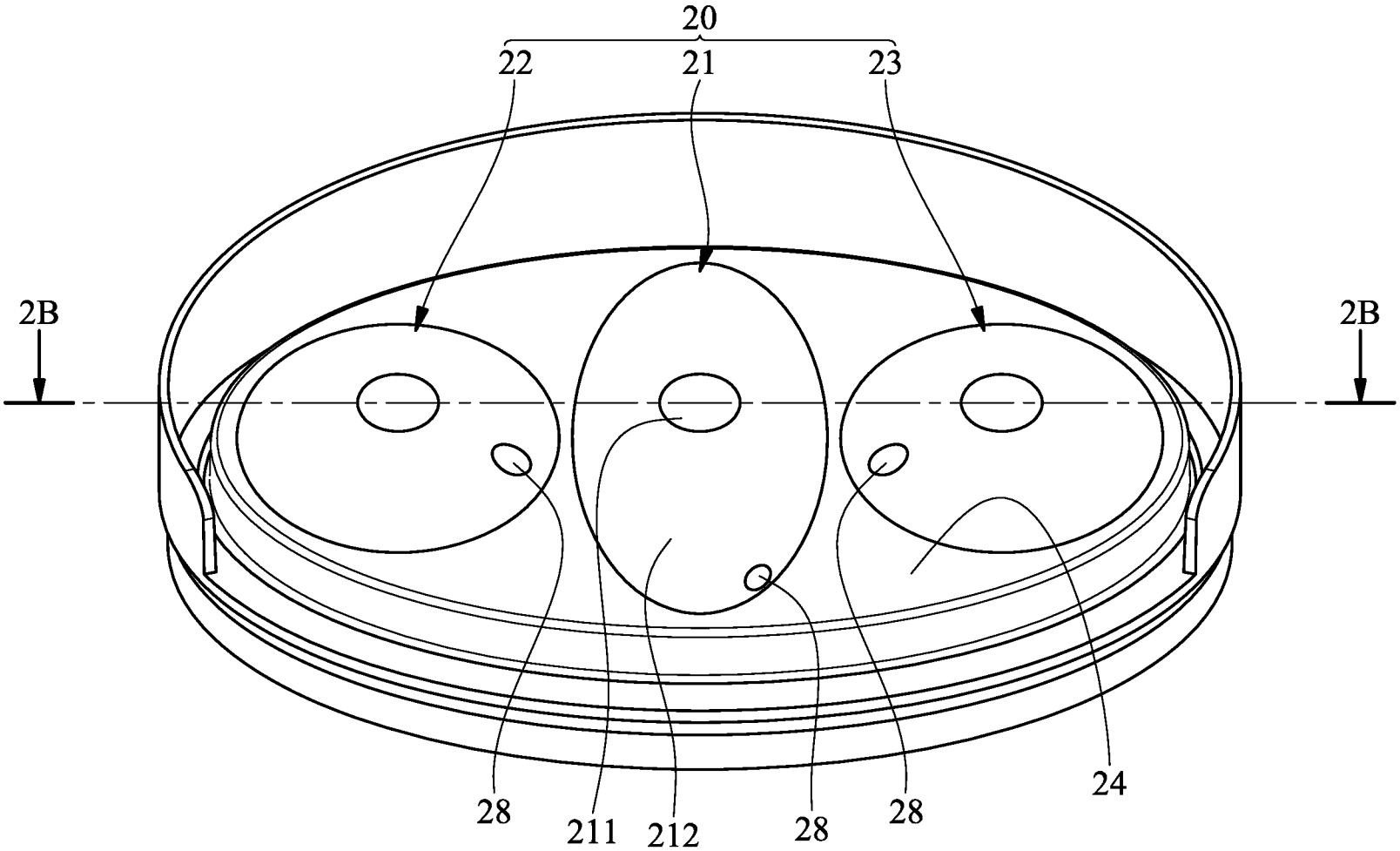
FIG. 2A is a perspective view of the antenna cover of the first embodiment of the invention.

FIG. 2A is a perspective view of the antenna cover C1 of the first embodiment of the invention. With reference to FIGS. 1 and 2A, the protrusions 20 comprise a first protrusion 21, a second protrusion 22 and a third protrusion 23. The waveguide paths 10 comprise a first waveguide path 11, a second waveguide path 12 and a third waveguide path 13. The first protrusion 21 corresponds to the first waveguide path 11. The second protrusion 22 corresponds to the second waveguide path 12. The third protrusion 23 corresponds to the third waveguide path 13. The first protrusion 21 is located between the second protrusion 22 and the third protrusion 23. In this embodiment, the first waveguide path 11 belongs to a first horn antenna to transmit a low-band signal, and the second waveguide path 12 belongs to a second horn antenna and the third waveguide path 13 belongs to a third horn antenna to transmit a high-band signal.

With reference to FIGS. 1 and 2A, taking the first protrusion 21 as an example, in this embodiment, each protrusion 20 has a top surface 211 and a lateral surface 212. The lateral surface 212 is located between the top surface 211 and the bottom surface 24. The top surface 211 is planar.

In this embodiment of the invention, the top surface of the protrusion is planar. The thickness of the top portion of the protrusion is decreased, and the radio frequency (RF) performance of the horn antenna module can be improved.

Figure 2B:
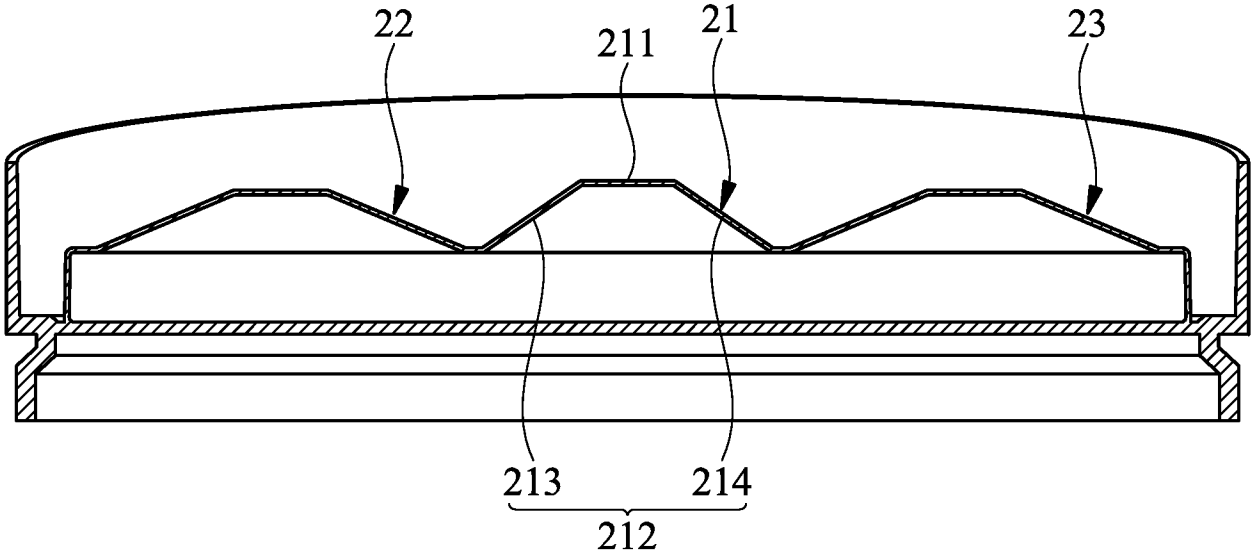
FIG. 2B is a sectional view along 2B-2B direction of the antenna cover of the FIG. 2A of the embodiment of the invention.

FIG. 2B is a sectional view along 2B-2B direction of the antenna cover C1 of the FIG. 2A of the embodiment of the invention. With reference to FIG. 2B, in this embodiment, taking the first protrusion 21 as an example, the lateral surface 212 forms a first side 213 and a second side 214 on a cross section. The cross section is perpendicular to the bottom surface. The first side 213 and the second side 214 are straight lines.

Figure 2C:
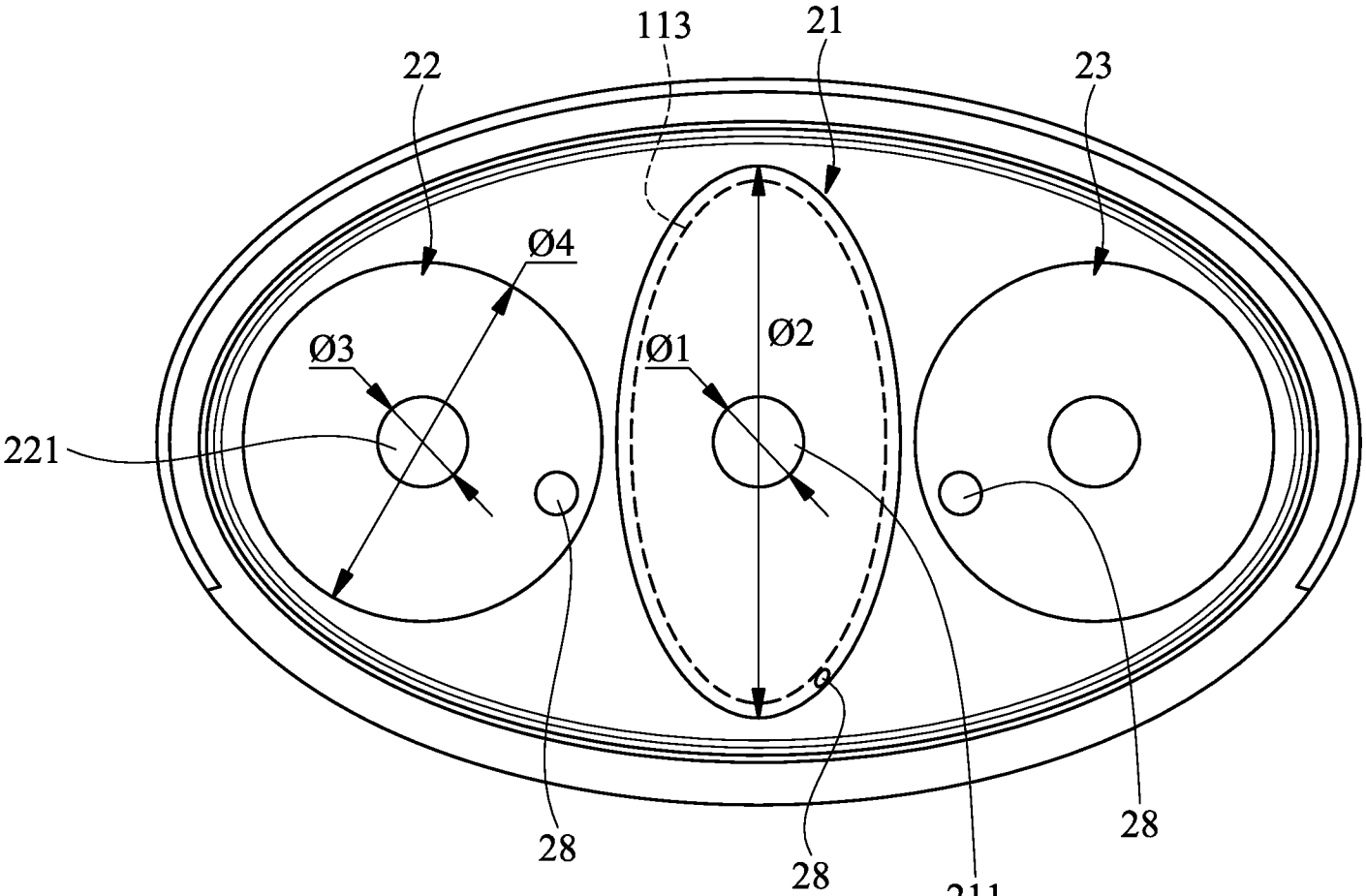
FIG. 2C is a top view of the antenna cover of the FIG. 2A of the embodiment of the invention.

FIG. 2C is a top view of the antenna cover C1 of the FIG. 2A of the embodiment of the invention. With reference to FIG. 2C, in this embodiment, the top surface 211 of the first protrusion 21 projects a first circular area on a projection plane (the projection plane is parallel to the bottom surface 24). The first protrusion 21 projects an elliptical area on the projection plane. The ratio of the diameter Φ1 of the first circular area to the major axis Φ2 of the elliptical area is between 0.05:1 and 0.4:1.

With reference to FIG. 2C, in this embodiment, the top surface 221 of the second protrusion 22 projects a second circular area on the projection plane. The second protrusion 22 projects a third circular area on the projection plane. The ratio of the diameter Φ3 of the second circular area to the diameter Φ4 of the third circular area is between 0.1:1 and 0.6:1.

With reference to FIG. 2B, in this embodiment, the height of the first protrusion is greater than the heights of the second protrusion and the third protrusion. However, the disclosure is not meant to restrict the invention. In another embodiment, the heights of the first protrusion, the second protrusion and the third protrusion can be modified. For example, the height of the first protrusion can be the same with the heights of the second protrusion and the third protrusion.

With reference to FIG. 1, in one embodiment, taking the first waveguide path and the first protrusion as an example, the first waveguide path 11 comprises a tube-shaped section 111 and a cone-shaped section 112. One end of the tube-shaped section 111 is connected to the narrow end of the cone-shaped section 112. A distance h1 is formed between the narrow end and the top surface 211 of the first protrusion 21. The distance h1 is equal to a quarter of the wavelength of the low-band signal.

With reference to FIGS. 2A and 2C, in one embodiment, each protrusion 20 comprises a material feed feature 28. The material feed feature 28 is formed on the lateral surface. Taking the first protrusion 21 as an example, the material feed feature 28 is formed on the lateral surface 212. The material feed feature 28 corresponds to an inlet of a mold for forming the antenna cover. In one embodiment, the material feed feature 28 is a circular recess. However, the material feed feature 28 can also be other shapes. In this embodiment, the material feed feature 28 is not formed on the top surface of the protrusion, the thickness of the top portion of the protrusion is therefore decreased, and the radio frequency (RF) performance of the horn antenna module can be improved.

With reference to FIG. 2C, in one embodiment, taking the first protrusion 21 as an example, the first waveguide path 11 projects a path area 113 on the projection plane. The projection of the material feed feature 28 on the projection plane is out of the path area 113. In this embodiment, the projection of the material feed feature 28 on the projection plane is out of the path area 113 to reduce the signal interference caused by the material feed feature 28. However, the disclosure is not meant to restrict the invention, in other embodiment, for example, the size of the antenna cover being too small, the projection of the material feed feature 28 on the projection plane maybe inside of the path area 113.

Figure 3A:
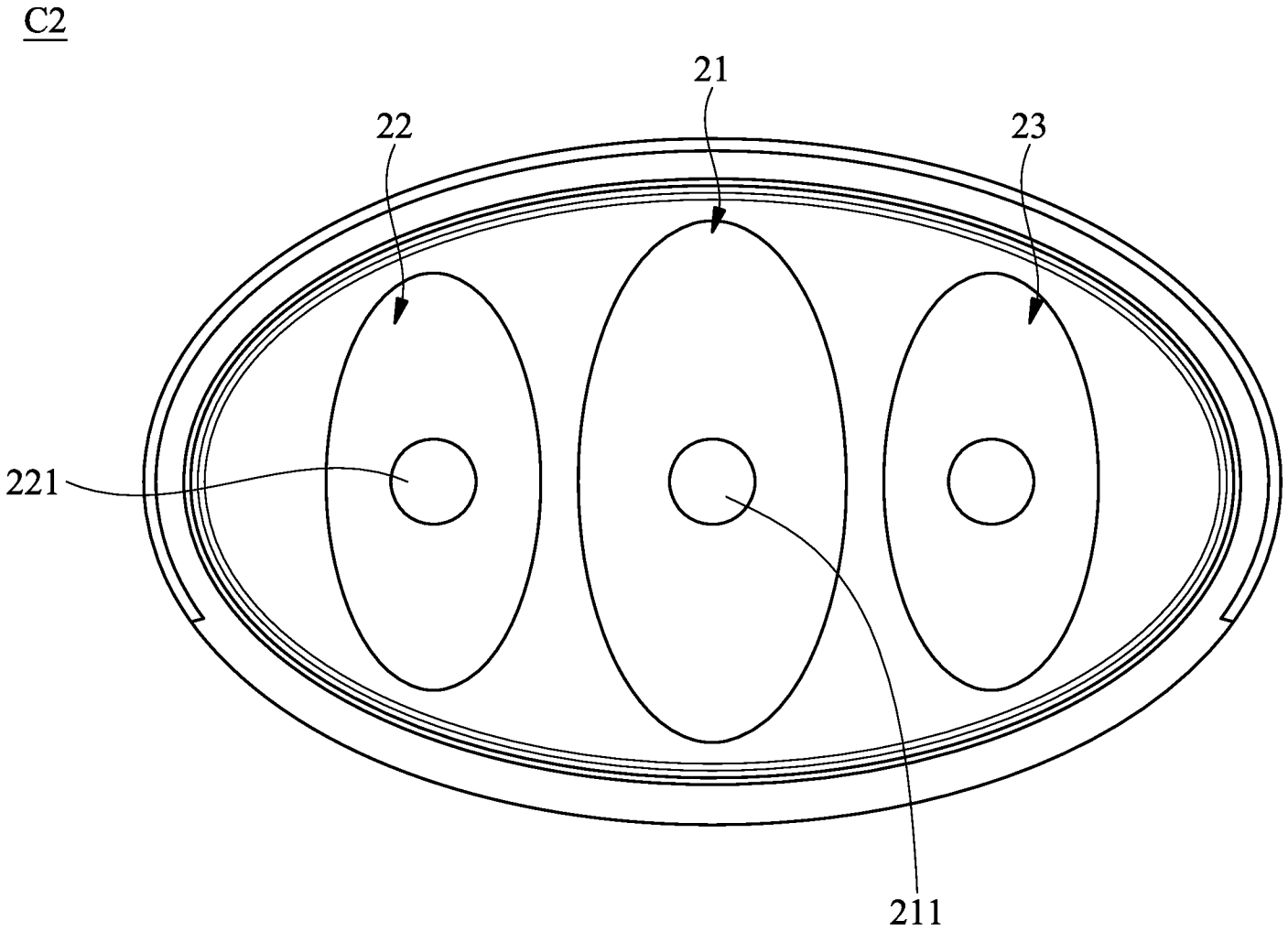
FIG. 3A shows an antenna cover of a second embodiment of the invention.
Figure 3B:
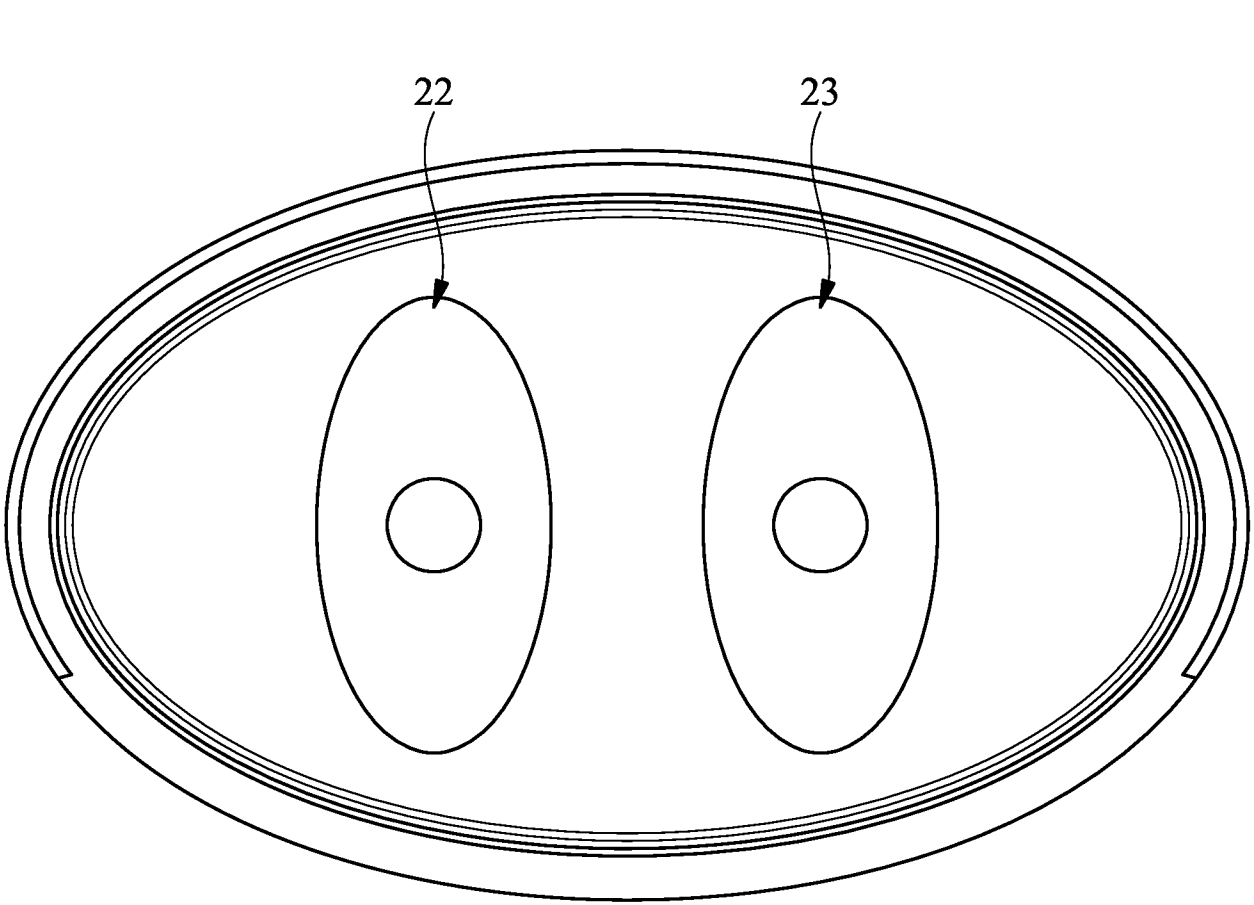
FIG. 3B shows an antenna cover of a third embodiment of the invention.
Figure 3C:
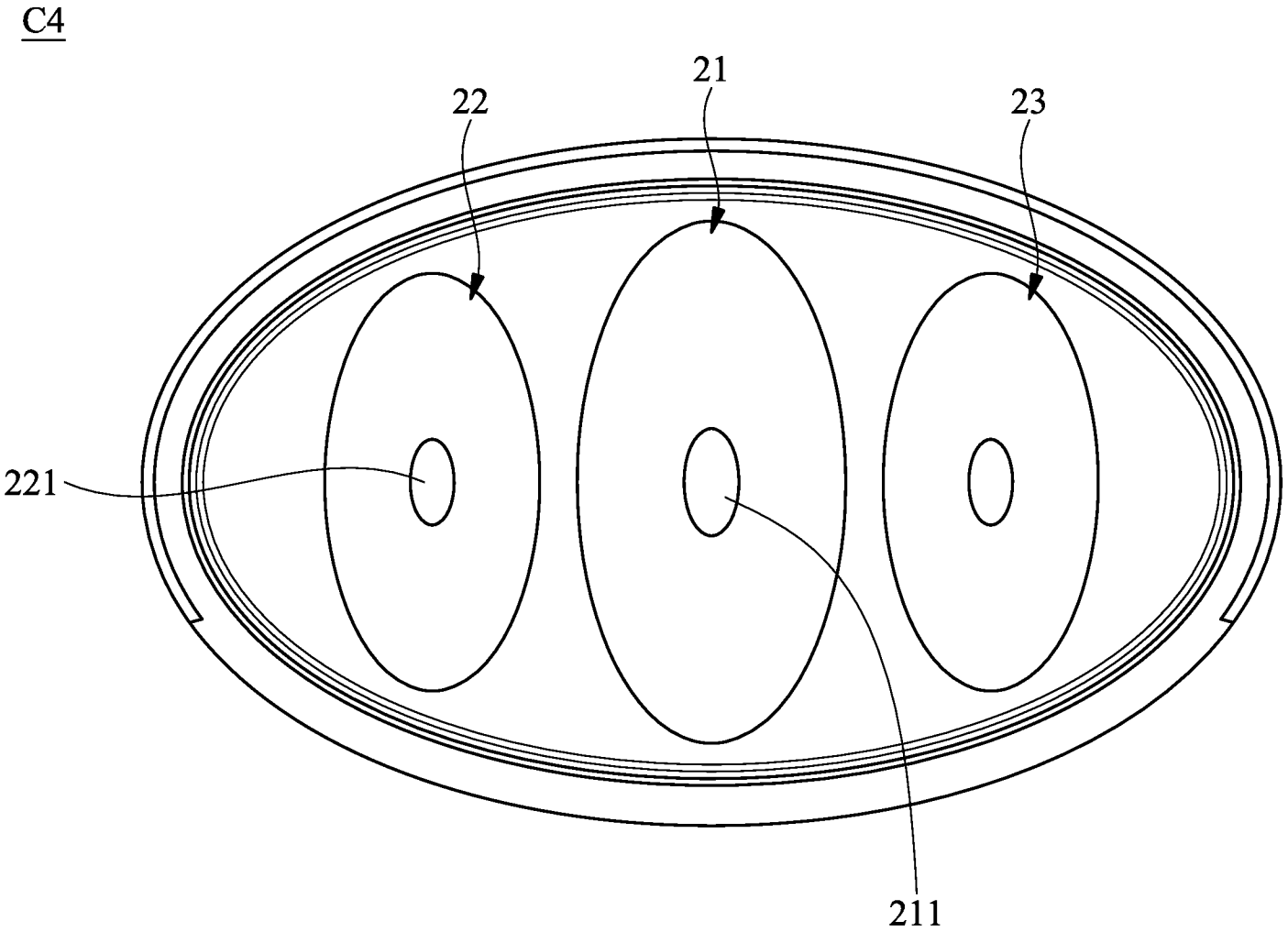
FIG. 3C shows an antenna cover of a fourth embodiment of the invention.

In the embodiments above, the top surface 211 of the first protrusion 21 projects the circular area on the projection plane. The first protrusion 21 projects the elliptical area on the projection plane. The top surface 221 of the second protrusion 22 projects the circular area on the projection plane. The second protrusion 22 projects the circular area on the projection plane. However, the disclosure is not meant to restrict the invention. FIG. 3A shows an antenna cover C2 of a second embodiment of the invention. With reference to FIG. 3A, in this embodiment, the second protrusion 22 and the third protrusion 23 project elliptical areas on the projection plane. FIG. 3B shows an antenna cover C3 of a third embodiment of the invention. With reference to FIG. 3B, in this embodiment, only two protrusions are formed on the antenna cover C3. FIG. 3C shows an antenna cover C4 of a fourth embodiment of the invention. With reference to FIG. 3C, in this embodiment, each top surface of each protrusion projects an elliptical area on the projection plane. According to the embodiments above, the shape of the projection areas of the protrusions and the top surfaces of the protrusions can the modified.

Figure 4A:
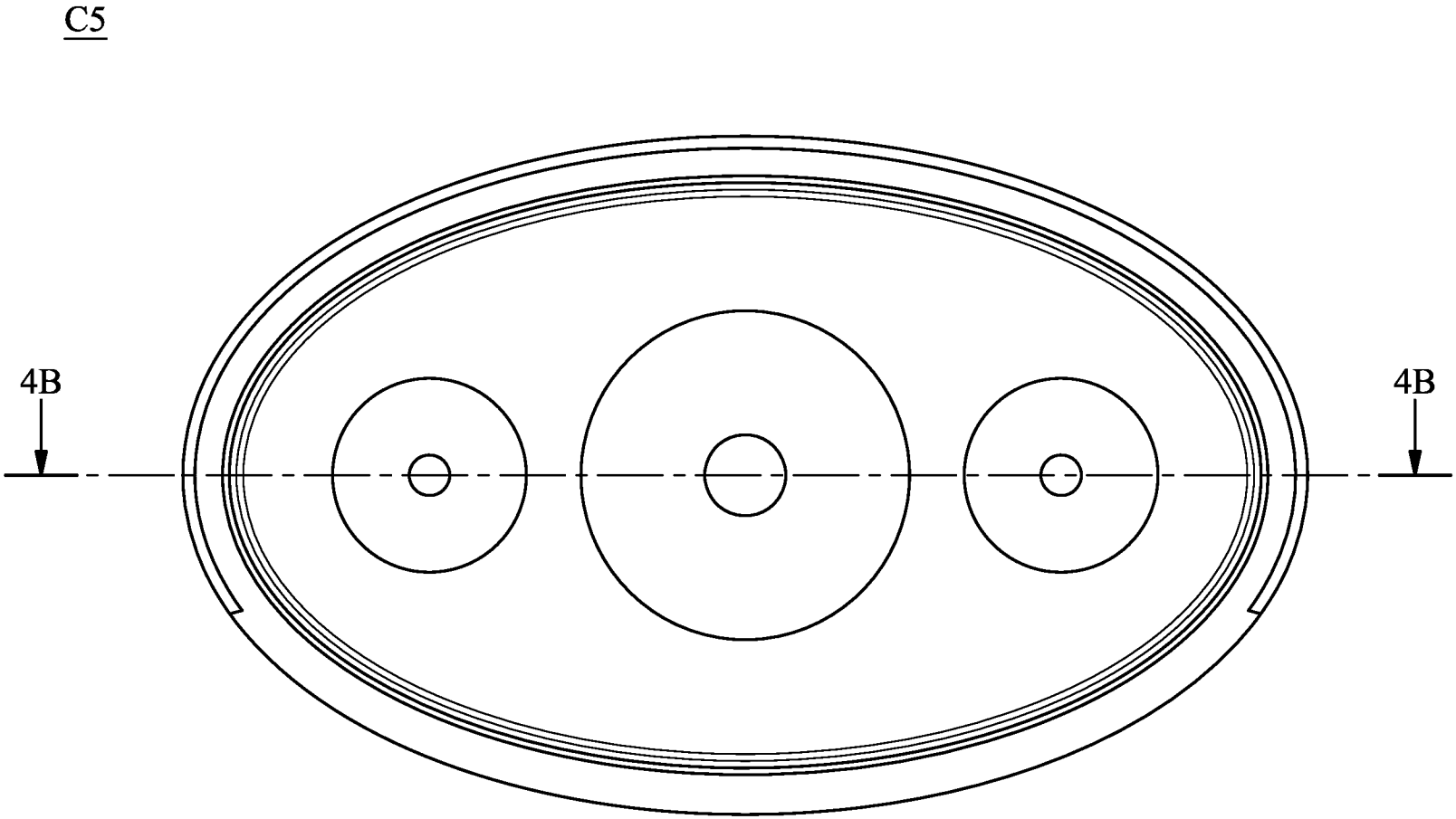
FIG. 4A shows an antenna cover of a fifth embodiment of the invention.
Figure 4B:
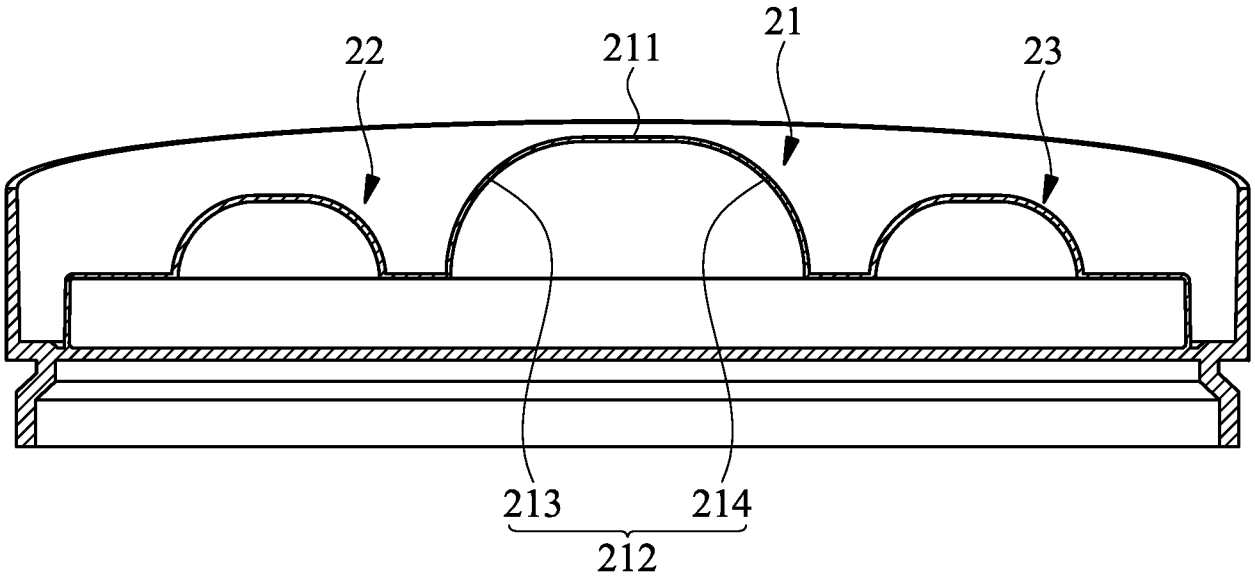
FIG. 4B is a sectional view along 4B-4B direction of the antenna cover of the FIG. 4A of the embodiment of the invention.

FIGS. 4A and 4B show an antenna cover C5 of a fifth embodiment of the invention. With reference to FIGS. 4A and 4B, in this embodiment, the lateral surface 212 forms a first side 213 and a second side 214 on a cross section (the cross section is perpendicular to the bottom surface), and the first side 213 and the second side 214 are curves with the same radius. The height of the first protrusion 21 differs from heights of the second protrusion 22 and the third protrusion 23.

Utilizing the horn antenna module and the antenna cover of the embodiment of the invention. The protrusions increase the strength of the antenna cover. The antenna cover therefore can resist the difference between the environmental pressure and the inner pressure of the horn antennas due to temperature change. The antenna cover is prevented from deforming, and the thickness of the antenna cover is reduced. The radio frequency (RF) performance of the horn antenna module is therefore improved. The shape of each protrusion can be optimized according to the corresponding waveguide to improve the performance of the horn antenna module. In one embodiment, the cross polarization of the converter utilizing the antenna cover of the embodiment of the invention can be more than 23 dB (full band).

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A horn antenna module, comprising:

a waveguide, comprising a plurality of waveguide paths; and an antenna cover, covering one end of the waveguide, wherein the antenna cover comprises a plurality of protrusions and a bottom surface, the protrusions are formed on the bottom surface, the protrusions correspond one-to-one with the waveguide paths, each protrusion has a top surface and a lateral surface, the lateral surface is located between the top surface and the bottom surface, and the entire top surface is planar, wherein the lateral surface forms a first side and a second side on a cross section, the cross section is perpendicular to the bottom surface, and the entire first side and the entire second side are straight lines.

2. The horn antenna module as claimed in claim 1, wherein the protrusions comprise a first protrusion, a second protrusion and a third protrusion, the waveguide paths comprise a first waveguide path, a second waveguide path and a third waveguide path, the first protrusion corresponds to the first waveguide path, the second protrusion corresponds to the second waveguide path, the third protrusion corresponds to the third waveguide path, the first protrusion is located between the second protrusion and the third protrusion, the first waveguide path transmits a low-band signal, and the second waveguide path and the third waveguide path transmit a high-band signal.

3. The horn antenna module as claimed in claim 2, wherein the top surface of the first protrusion projects a first circular area on a projection plane, the projection plane is parallel to the bottom surface, the first protrusion projects an elliptical area on the projection plane, a ratio of a diameter of the first circular area to the major axis of the elliptical area is between 0.05:1 and 0.4:1.

4. The horn antenna module as claimed in claim 3, wherein the top surface of the second protrusion projects a second circular area on the projection plane, the second protrusion projects a third circular area on the projection plane, and the ratio of the diameter of the second circular area to the diameter of the third circular area is between 0.1:1 and 0.6:1.

5. The horn antenna module as claimed in claim 2, wherein a height of the first protrusion differs from heights of the second protrusion and the third protrusion.

6. The horn antenna module as claimed in claim 2, wherein the first waveguide path comprises a tube-shaped section and a cone-shaped section, one end of the tube-shaped section is connected to a narrow end of the cone-shaped section, a distance is formed between the narrow end and the top surface of the first protrusion, and the distance is equal to a quarter of a wavelength of the low-band signal.

7. A horn antenna module, comprising:

a wavequide, comprising a plurality of wavequide paths; and an antenna cover, covering one end of the wavequide, wherein the antenna cover comprises a plurality of protrusions and a bottom surface, the protrusions are formed on the bottom surface, the protrusions correspond one-to-one with the wavequide paths, each protrusion has a top surface and a lateral surface, the lateral surface is located between the top surface and the bottom surface, and the top surface is planar, wherein each protrusion comprises a material feed feature, and the material feed feature is formed on the lateral surface.

8. The horn antenna module as claimed in claim 7, wherein the waveguide path projects a path area on a projection plane, the projection plane is parallel to the bottom surface, and a projection of the material feed feature on the projection plane is out of the path area.

9. The horn antenna module as claimed in claim 7, wherein the material feed feature is a recess.

10. An antenna cover, covering an end of a waveguide, comprising:

a plurality of protrusions; and a bottom surface, wherein the protrusions are formed on the bottom surface, each protrusion has a top surface and a lateral surface, the lateral surface is located between the top surface and the bottom surface, and the entire top surface is planar, wherein the lateral surface forms a first side and a second side on a cross section, the cross section is perpendicular to the bottom surface, and the entire first side and the entire second side are straight lines.

11. The antenna cover as claimed in claim 10, wherein the protrusions comprise a first protrusion, a second protrusion, and a third protrusion, the first protrusion is located between the second protrusion and the third protrusion, the top surface of the first protrusion projects a first circular area on a projection plane, the projection plane is parallel to the bottom surface, the first protrusion projects an elliptical area on the projection plane, and the ratio of the diameter of the first circular area to the major axis of the elliptical area is between 0.05:1 and 0.4:1.

12. The antenna cover as claimed in claim 11, wherein the top surface of the second protrusion projects a second circular area on the projection plane, the second protrusion projects a third circular area on the projection plane, and the ratio of the diameter of the second circular area to the diameter of the third circular area is between 0.1:1 and 0.6:1.

13. An antenna cover, covering an end of a waveguide, comprising:

a plurality of protrusions; and a bottom surface, wherein the protrusions are formed on the bottom surface, each protrusion has a top surface and a lateral surface, the lateral surface is located between the top surface and the bottom surface, and the top surface is planar, wherein each protrusion comprises a material feed feature, and the material feed feature is formed on the lateral surface.

14. The antenna cover as claimed in claim 13, wherein the material feed feature is a recess.

* * * * *